US008922311B2

(12) United States Patent
Pal et al.

(10) Patent No.: US 8,922,311 B2
(45) Date of Patent: Dec. 30, 2014

(54) ELECTRICAL INDUCTOR ASSEMBLY AND METHOD OF COOLING AN ELECTRICAL INDUCTOR ASSEMBLY

(71) Applicants: Debabrata Pal, Hoffman Estates, IL (US); John Horowy, Rockford, IL (US)

(72) Inventors: Debabrata Pal, Hoffman Estates, IL (US); John Horowy, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 20 days.

(21) Appl. No.: 13/626,536

(22) Filed: Sep. 25, 2012

(65) Prior Publication Data

US 2014/0085025 A1 Mar. 27, 2014

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/30*** | (2006.01) |
| ***H01F 7/06*** | (2006.01) |

(52) U.S. Cl.

USPC ..... 336/61; 336/57; 336/58; 336/96; 336/208; 29/602.1

(58) Field of Classification Search

USPC ..... 336/90, 195, 196, 207, 208, 212, 229, 336/55–62; 29/602.1, 606

See application file for complete search history.

(56) References Cited

U.S. PATENT DOCUMENTS

| | | | | |
|---|---|---|---|---|
| 3,179,908 | A | 4/1965 | Peabody | |
| 3,374,452 | A * | 3/1968 | Judd | 336/60 |
| 5,682,292 | A * | 10/1997 | Salanki | 361/699 |
| 7,710,228 | B2 * | 5/2010 | Feng et al. | 336/61 |
| 8,125,777 | B1 | 2/2012 | MacLennan et al. | |
| 2007/0295715 | A1 | 12/2007 | Saka et al. | |
| 2009/0128273 | A1 * | 5/2009 | Huss et al. | 336/61 |
| 2009/0128276 | A1 * | 5/2009 | Horowy et al. | 336/96 |
| 2009/0146769 | A1 * | 6/2009 | Feng et al. | 336/90 |
| 2011/0215891 | A1 * | 9/2011 | Sundstrom et al. | 336/65 |

FOREIGN PATENT DOCUMENTS

| | | |
|---|---|---|
| EP | 0490438 A1 | 6/1992 |
| EP | 2061043 A1 | 5/2009 |
| EP | 2061045 A2 | 5/2009 |

OTHER PUBLICATIONS

European Search Report regarding related EP Application No. 13177825.0; dated Feb. 17, 2014; 9 pgs.

* cited by examiner

*Primary Examiner* — Mangtin Lian
(74) *Attorney, Agent, or Firm* — Cantor Colburn LLP

(57) ABSTRACT

An electrical inductor assembly includes an inductor core having a relatively circular geometry. Also included is a wire guide surrounding and retaining the inductor core, the wire guide having a plurality of slots for retaining and guiding a plurality of wires. Further included is an outer housing surrounding and retaining the wire guide and a substance disposed within at least one of the plurality of slots of the wire guide.

12 Claims, 2 Drawing Sheets

ELECTRICAL INDUCTOR ASSEMBLY AND METHOD OF COOLING AN ELECTRICAL INDUCTOR ASSEMBLY

BACKGROUND OF THE INVENTION

The present invention relates to electrical inductors, and more particularly to thermal management of an electrical inductor assembly, as well as a method of cooling the electrical inductor assembly.

Electrical inductors are commonly used in circuits for various reasons, such as filtering electrical current. A typical inductor includes a core material and a plurality of insulated wires wrapped around the core multiple times, with each wire corresponding to a phase of electrical current. One application for an inductor is as part of a power filter in a motor controller. In vehicle motor control systems, particularly aerospace systems, it is desirable to reduce the size and weight of components. Unfortunately, reducing the size of an inductor reduces an inductor's surface area of the inductor, thereby making heat dissipation more difficult. Additionally, current materials employed often have poor thermal conductivity, which therefore hinders efforts to thermally couple the core to cooling elements and to dissipate heat from the core. Reduced heat dissipation is particularly disadvantageous based on the high temperature sensitivity that the core material and the wires have.

BRIEF DESCRIPTION OF THE INVENTION

According to one embodiment, an electrical inductor assembly includes an inductor core having a relatively circular geometry. Also included is a wire guide surrounding and retaining the inductor core, the wire guide having a plurality of slots for retaining and guiding a plurality of wires. Further included is an outer housing surrounding and retaining the wire guide and a substance disposed within at least one of the plurality of slots of the wire guide.

According to another embodiment, a method of cooling an electrical inductor assembly is provided. The method includes disposing a substance within at least one of a plurality of slots of a wire guide surrounding and retaining an inductor core. Also included is surrounding and retaining the wire guide and the substance with an outer housing disposed proximate a radially outer portion of the wire guide.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
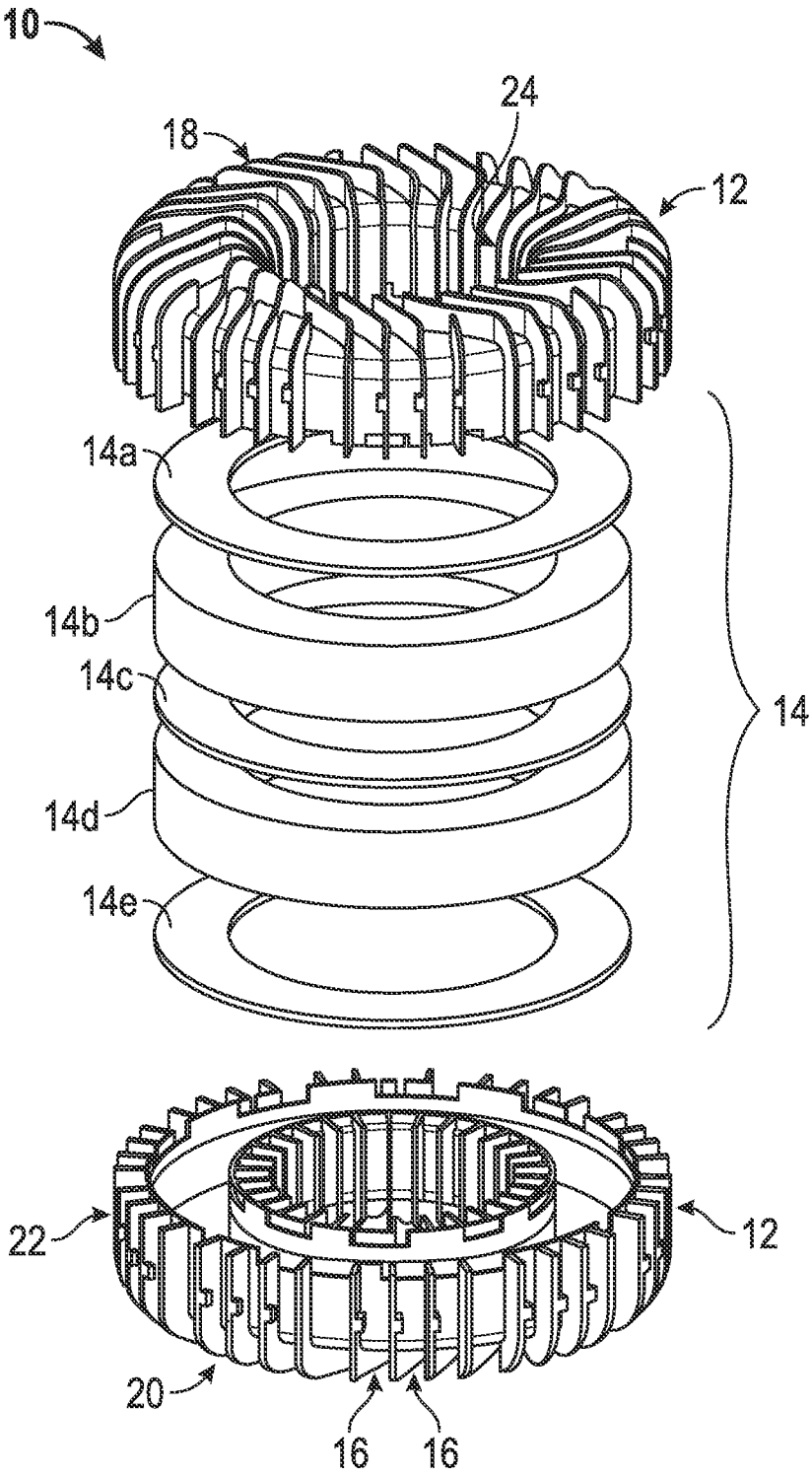
FIG. 1 is an exploded, perspective view of an electrical inductor assembly.

Referring to FIG. 1, an electrical inductor assembly 10 is illustrated in an exploded view. Specifically, illustrated is a portion of a core and wire guide assembly. The electrical inductor assembly 10 described herein may be employed in a variety of applications, with one such application being part of a power filter in a motor controller (not illustrated). The motor controller may be used in conjunction with an assembly or system of a vehicle, such as an aircraft, however, it is contemplated that other vehicles may benefit from the embodiments described herein. Furthermore, in one embodiment, the electrical inductor assembly 10 is configured to be a common mode inductor, wherein each of a plurality of wires are configured so that current flows through each of the wires in the same direction.

The electrical inductor assembly 10 includes a wire guide 12 that is shown as two separate portions that are coupled together upon final assembly. The wire guide 12 surrounds and retains an inductor core 14 having a relatively circular geometry. In an exemplary embodiment, the inductor core 14 is formed of a plurality of core portions 14*a*, 14*b*, 14*c*, 14*d* and 14*e*. One or more insulating layers may be applied to various portions of one or more of the plurality of core portions 14*a*, 14*b*, 14*c*, 14*d* and 14*e* to fasten the portions together and to electrically isolate the inductor core 14 from a plurality of wires that will be discussed below in detail. An adhesive may be applied to one or more portions of the inductor core 14 to fasten the inductor core 14 to the wire guide 12. In one embodiment, the inductor core 14 is made of a nanocrystalline magnetic material, such as Vitroperm® VP500F, although it is to be understood that numerous other materials may be employed. In an exemplary embodiment, core portions 14*a*, 14*c* and 14*e* are electrically insulating adhesive layers, while core portions 14*b* and 14*d* are a nanocrystalline alloy, such as Vitroperm®, for example.

The wire guide 12 is configured to guide a plurality of wires (not illustrated) which form a plurality of windings. The plurality of wires are disposed within a plurality of slots 16 that form paths winding around the inductor core 14. The plurality of slots 16 allow the plurality of wires to be closely wound together around the wire guide 12, while remaining electrically isolated from each other. Additionally, as illustrated, the plurality of slots 16 are disposed proximate a top portion 18, a bottom portion 20, a radially outer portion 22 and a radially inner portion 24 of the wire guide 12. The wire guide 12 is formed of a thermal plastic material that is thermally conductive and electrically non-conductive. Specifically, the thermal plastic material may have a thermal conductivity of about 10-20 W/m-K. Although it is contemplated that various materials may be suitable, in one embodiment, the material CoolPoly® may be employed to satisfy the above-noted properties.

Figure 2:
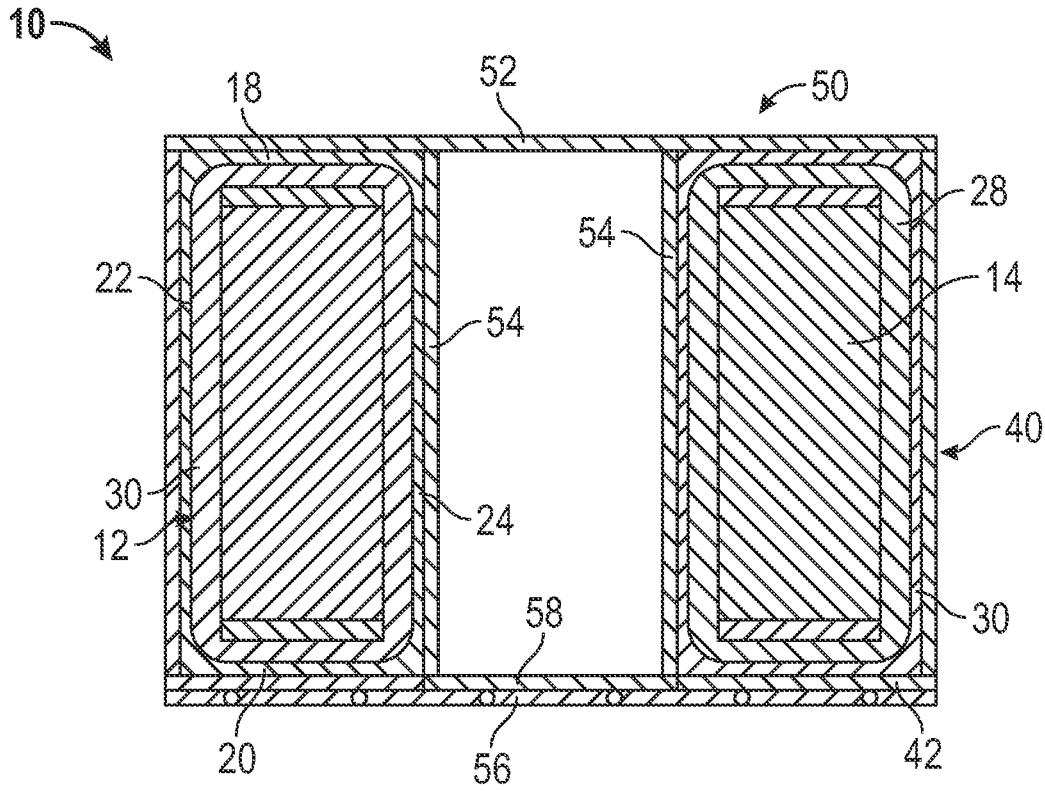
FIG. 2 is a side, cross-sectional view of the electrical inductor assembly.

Referring to FIG. 2, a cross-sectional view illustrates the electrical inductor assembly 10 in additional detail. Specifically, components for directly or indirectly thermally coupling the inductor core 14 to cooling elements are illustrated. The inductor core 14 is typically formed of a material that is highly sensitive to temperature, such that effective cooling is advantageous for overall efficiency of the electrical inductor assembly 10. A substance 30 is disposed at least partially within at least one, but typically all of the plurality of slots 16 to electrically isolate the plurality of wires disposed therein, and to thermally couple the plurality of wires to various cooling elements that will be described below. The substance 30 may comprise various materials, and in an exemplary embodiment, the substance 30 comprises a high thermal conductivity compound, similar or identical to that of the material of the wire guide 12 described above. In an alternative embodiment, the substance 30 may comprise an epoxy resin compound, such as boron nitride based high conductivity potting compound. In yet another alternative embodiment, the substance 30 may comprise a Stycast® potting compound. The preceding list is merely illustrative and it is to be appreciated that numerous other compounds are contemplated.

To surround and retain the wire guide 12, as well as the substance 30, an outer housing 40 is disposed proximate the radially outer portion 22 of the wire guide 12. The outer housing 40 extends circumferentially around the radially outer portion 22 to enclose the substance 30 disposed within the plurality of slots 16. Additionally, the outer housing 40 may extend radially inwardly along the bottom portion 20 of the wire guide 12. Similar to the wire guide 12 and the substance 30, the outer housing 40 is formed of a thermal plastic material comprising a high thermal conductivity compound, such as those described in detail above.

A heat sink arrangement 50 includes a top plate 52 disposed proximate the top portion 18 of the wire guide 12 and may be formed of a ring-like geometry that extends radially inwardly to the radially inner portion 24 of the wire guide 12 or may be a fully circular plate that extends radially inwardly past the radially inner portion 24, as illustrated. The heat sink arrangement 50 also includes a cylindrical structure 54 disposed proximate the radially inner portion 24 of the wire guide 12 and extends therealong from the top plate 52 to a cold plate 56 located proximate the bottom portion 20 of the wire guide 12. The cold plate 56 is typically cooled by a fluid that is routed throughout interior portions of the cold plate 56. The top plate 52 and the cylindrical structure 54 are typically formed of a metal, such as aluminum, for example, however, alternative materials are contemplated. The top plate 52 and the cylindrical structure 54 are operably coupled via any suitable fastening process, such as mechanical fasteners or welding. It is also contemplated that the top plate 52 and the cylindrical structure 54 are integrally formed, such as by casting the heat sink arrangement 50.

The outer housing 40 and the heat sink arrangement 50 are configured to thermally couple the inductor core 14 and the plurality of wires forming a winding 28 to the cold plate 56 and to dissipate heat from the inductor core 14 and the winding 28. The thermal coupling and the heat dissipation is facilitated by operably coupling, or disposing in close contact, the outer housing 40 and the heat sink arrangement 50 to the cold plate 56. For the heat sink arrangement 50, a bottom region 58 of the cylindrical structure 54 is disposed adjacent the cold plate 56. The bottom region 58 may simply comprise a bottom edge of the cylindrical structure 54 or may be a bottom plate that fully extends around the radially inner portion 24 of the wire guide 12. The outer housing 40 may be disposed adjacent the cold plate 56 via a bottom section 42 of the outer housing 40. Additionally, the outer housing 40 and the heat sink arrangement 50 may be operably coupled to each other or disposed in close contact.

Figure 3:
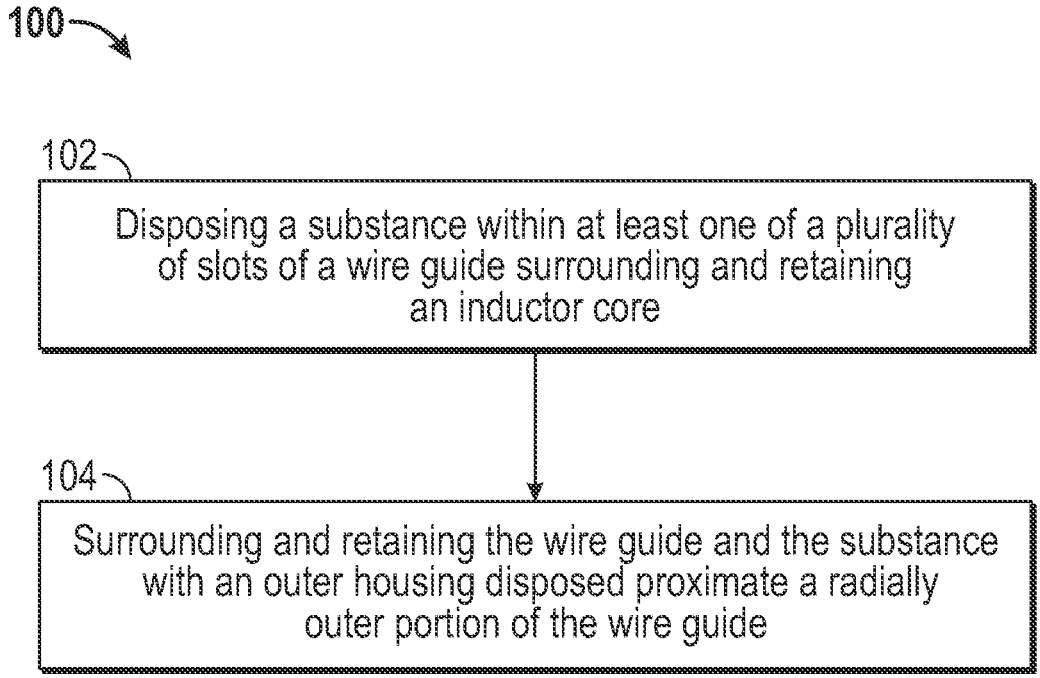
FIG. 3 is a flow diagram illustrating a method of cooling the electrical inductor assembly.

A method of cooling an electrical inductor assembly 100 is also provided as illustrated in FIG. 3 and with reference to FIGS. 1 and 2. The electrical inductor assembly 10 has been previously described and specific structural components need not be described in further detail. The method for cooling an electrical inductor assembly 100 includes disposing a substance within at least one of a plurality of slots of a wire guide surrounding and retaining an inductor core 102. The wire guide and the substance is surrounded and retained with an outer housing disposed proximate a radially outer portion of the wire guide 104. Additionally, a heat sink arrangement may be disposed along a radially inner portion of the wire guide, as described in detail above.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electrical inductor assembly comprising:

an inductor core having a relatively circular geometry;

a wire guide surrounding and retaining the inductor core, the wire guide having a plurality of slots for retaining and guiding a plurality of wires;

an outer housing surrounding and retaining the wire guide and a substance disposed within at least one of the plurality of slots of the wire guide, wherein the substance comprises a high thermal conductivity compound thermoplastic material; and a heat sink arrangement comprising:

a top plate formed of metal and disposed proximate a top region of the wire guide;

a cylindrical structure formed of metal and disposed along a radially inner portion of the wire guide; and a cold plate in operative direct contact with a bottom region of the cylindrical structure, wherein the cold plate is configured to route a fluid throughout an interior portion of the cold plate for cooling of the cold plate, wherein the bottom region comprises a bottom edge of the cylindrical structure the forms a solid structure that extends no further than a radially outer edge of the cylindrical structure.

2. The electrical inductor assembly of claim 1, wherein the cylindrical structure and the top plate are mechanically fastened to each other.

3. The electrical inductor assembly of claim 2, wherein the cylindrical structure and the top plate are welded to each other.

4. The electrical inductor assembly of claim 1, wherein the wire guide comprises a thermal plastic material.

5. The electrical inductor assembly of claim 1, wherein the substance comprises an epoxy resin compound.

6. The electrical inductor assembly of claim 1, wherein the outer housing comprises a thermal plastic material.

7. The electrical inductor assembly of claim 6, wherein the thermal plastic material has thermally conductive properties and electrically non-conductive properties.

8. The electrical inductor assembly of claim 1, wherein the cylindrical structure of the heat sink arrangement is thermally coupled to the outer housing.

9. The electrical inductor assembly of claim 1, wherein the outer housing and the cylindrical structure are thermally coupled to the cold plate.

10. A method of cooling an electrical inductor assembly comprising:

disposing a substance within at least one of a plurality of slots of a wire guide surrounding and retaining an inductor core, the substance comprising a high thermal conductivity compound thermoplastic material;

surrounding and retaining the wire guide and the substance with an outer housing disposed proximate a radially outer portion of the wire guide;

disposing an entirely metal heat sink arrangement in operable communication with the electrical inductor assembly by positioning a top plate proximate a top region of the wire guide and positioning a cylindrical structure proximate a radially inner region of the wire guide;

directly contacting a cold plate with a bottom region of the cylindrical structure, wherein the bottom region comprises a bottom edge of the cylindrical structure that forms a solid structure that extends no further than a radially outer edge of the cylindrical structure; and routing a fluid throughout an interior portion of the cold plate.

11. The method of claim 10, wherein disposing the heat sink arrangement in operable communication with the electrical inductor assembly comprises wherein the top plate and the cylindrical structure are mechanically fastened to each other.

12. The method of claim 11, further comprising welding the top plate to the cylindrical structure.

* * * * *